US005878536A

United States Patent [19]

Demmitt et al.

[11] Patent Number: 5,878,536

[45] Date of Patent: Mar. 9, 1999

[54] NEONATAL INFANT CARE HEADWALL

[75] Inventors: Cathy Demmitt; David Vandenberg; Lori Rodine; Macklyn Rhett Sellers; Currie A. Dail, all of Charlotte, N.C.

[73] Assignee: The Charlotte-Mecklenburg Hospital Authority, Charlotte, N.C.

[21] Appl. No.: 864,668

[22] Filed: May 28, 1997

[51] Int. Cl.[6] ..... E06B 9/15

[52] U.S. Cl. ..... 52/36.4; 312/209; 312/223.6

[58] Field of Search ..... 52/28, 36.4, 220.1, 52/36.1, 36.2, 27, 220.8, 220.5, 220.7; 312/209, 223.1, 223.3, 223.6; 174/48, 49

[56] References Cited

U.S. PATENT DOCUMENTS

| | | | |
|---|---|---|---|
| 2,386,092 | 10/1945 | Cornish | 312/239 X |
| 3,660,591 | 5/1972 | Schultz et al. | 52/28 X |
| 3,769,502 | 10/1973 | Schultz et al. | 52/28 X |
| 4,080,022 | 3/1978 | Canfield | 312/239 |
| 4,338,485 | 7/1982 | Fullenkamp | 312/209 X |
| 4,753,055 | 6/1988 | Durham | 52/28 |
| 4,905,433 | 3/1990 | Miller | 52/220.1 X |
| 5,060,425 | 10/1991 | Kappers et al. | 52/36.4 |
| 5,061,018 | 10/1991 | Pederson | 312/209 |
| 5,299,338 | 4/1994 | Foster | 312/209 X |
| 5,323,565 | 6/1994 | Kappers et al. | 52/36.4 |
| 5,448,859 | 9/1995 | Walker | 52/220.1 X |
| 5,537,289 | 7/1996 | Dahl | 312/209 X |
| 5,618,090 | 4/1997 | Montague | 312/209 |
| 5,653,064 | 8/1997 | Kappers et al. | 52/36.4 |

*Primary Examiner*—Christopher Kent
*Assistant Examiner*—Beth A. Aubery
*Attorney, Agent, or Firm*—Kennedy, Covington, Lobdell & Hickman, LLP

[57] ABSTRACT

A neonatal infant care headwall fixture defining an infant care station for concentrating infant care equipment in a neonatal health care facility includes a body formed from a plurality of wall members with at least one vertically extending wall member defining a front surface and at least one horizontally extending wall member defining a top surface with the front surface and top surface cooperating to define a recess for receiving therein at least a portion of an infant support structure to positively locate the infant support structure and to locate infant care equipment associated with the headwall fixture in juxtaposition with an infant support structure at least partially disposed with the recess.

18 Claims, 4 Drawing Sheets

NEONATAL INFANT CARE HEADWALL

BACKGROUND OF THE INVENTION

The present invention relates broadly to hospital fixtures and, more particularly, to a headwall fixture which defines a station for neonatal infant care and provides a cluster of necessary services, equipment and accessories.

Neonatal infant care facilities are areas in hospitals which care for premature babies and other infants who are in some form of medical distress. They may be placed in cribs or incubators and, as is common in modern hospitals, typically require a plethora of equipment to support and sustain life.

As is also common, neonatal infant care is provided in large rooms with a plurality of individual stations that provide all the necessary equipment to care for one infant thereat. The equipment typically includes air, vacuum, oxygen and electrical services. Further, blood pressure monitors, heart monitors, and other analyzers are common. Additionally, tools and hand-held instrumentation need to be close at hand.

Currently, neonatal headwall fixtures are typically rectangular cabinets having flat walls. A crib or incubator on wheels is rolled into a position adjacent the cabinet and positioned at whatever orientation provides the best access to the necessary services, instrumentation and accessories. Such an arrangement remains unfocused in that the infant support device, be it crib or incubator, may be positioned in virtually any orientation with respect to the headwall fixture. This is likely a sufficient arrangement, yet it is less than ideal for attending to neonatal infant care.

SUMMARY OF THE INVENTION

It is accordingly an object of the present invention to provide a neonatal infant care headwall fixture with a focused array of equipment.

It is another object of the present invention to provide such a headwall fixture which provides a positive location for the infant support device and convenient access to the necessary services and equipment.

To that end, a neonatal infant care headwall fixture defining an infant care station for concentrating infant care equipment in a neonatal infant care facility includes a body formed from a plurality of wall members including at least one vertically extending wall member defining a front surface and at least one horizontally extending wall member defining a top surface, the front surface and the top surface cooperating to define a recess for receiving therein at least a portion of an infant support structure to locate infant care equipment associated with the headwall fixture in juxtaposition with an infant support structure at least partially disposed within the recess.

Preferably, the front surface defining the recess includes three vertically oriented wall members disposed in a predetermined angular relationship with one another to define the recess in the vertically extending wall member. Preferably, the top surface includes three angularly oriented edge portions disposed in juxtaposition with the three vertically oriented wall members to define the recess in the horizontally extending wall surface.

It is preferred that the headwall fixture include at least one tower projecting upwardly from the horizontally oriented wall member for supporting infant care equipment associated with the headwall fixture. Preferably, the tower includes an electrical power supply accessible from outside the tower. It is further preferred that the tower include an arrangement for mounting infant care equipment thereto with the mounting arrangement including an assembly for releasably retaining the mounting arrangement at a predetermined vertical spacing from the top surface. It is further preferred that the mounting arrangement include an equipment support arm extending from the tower in a cantilevered manner.

It is additionally preferred that the assembly for releasably retaining the mounting arrangement at a predetermined vertical spacing from the top surface includes a vertically oriented slider rack mounted to the tower, a slider movably disposed within the slider rack and having a support arm mounted thereto and an assembly for releasably locking the slider in a predetermined position along the slider rack for supported vertical positioning of infant care equipment along the tower. The equipment support arm preferably includes at least one downwardly projecting support member mounted thereto for supporting infant care equipment suspended therefrom. Further, a second cantilevered support arm is mounted to the tower and the at least one downwardly projecting member to stabilize the downwardly projecting member.

Preferably, the body includes a plurality of selectively accessible storage compartments disposed therein with access to the storage compartments being available from the front surface. Further, at least one of the three vertically oriented wall members includes an assembly for accessing electrical power formed therein. Preferably, the assembly for accessing electrical power includes at least one electrical socket mounted to one of the vertically oriented wall members.

By the above, the present invention provides an efficient neonatal infant care headwall fixture which positively locates the infant support structure and gathers the necessary equipment for infant care in an efficient arrangement to enhance the ability of caregivers to sustain and support neonatal infant life.

DETAILED DESCRIPTION OF THE PREFERRED EMBODIMENT

Figure 1:
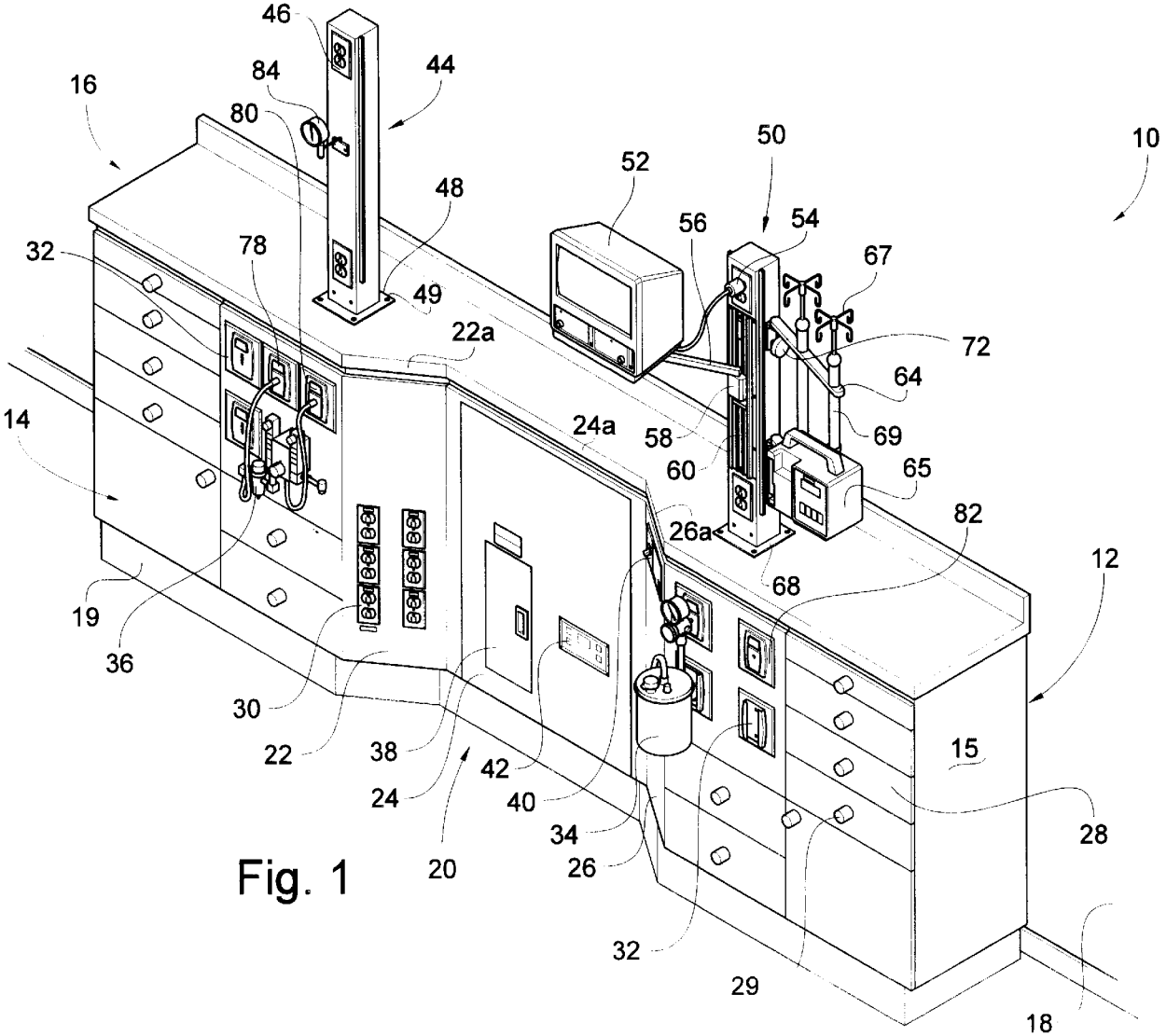
FIG. 1 is a perspective view of a neonatal infant care headwall fixture according to the preferred embodiment of the present invention.

Turning now to the drawings and, more particularly, to FIG. 1, a neonatal infant care headwall fixture defining an infant care station for concentrating infant care equipment in a neonatal infant care facility is illustrated generally at 10 and includes a generally elongate floor-standing body 12 mounted against a hospital room wall 18. The fixture 10 includes a front surface 14, a top surface 16 mounted at right angles thereto, and a side wall surface 15 mounted at right angles to both the front surface 14 and the top surface 16. The top surface 16 is formed as a generally planar countertop with the front surface 14 projecting downwardly therefrom with a baseboard 19 intermediate the lower portion of the front surface 14, side surface 15 and the floor. It should be noted that several fixtures according to the present invention may be used in abutment with one another, thereby concealing the side wall 15.

Figure 3:
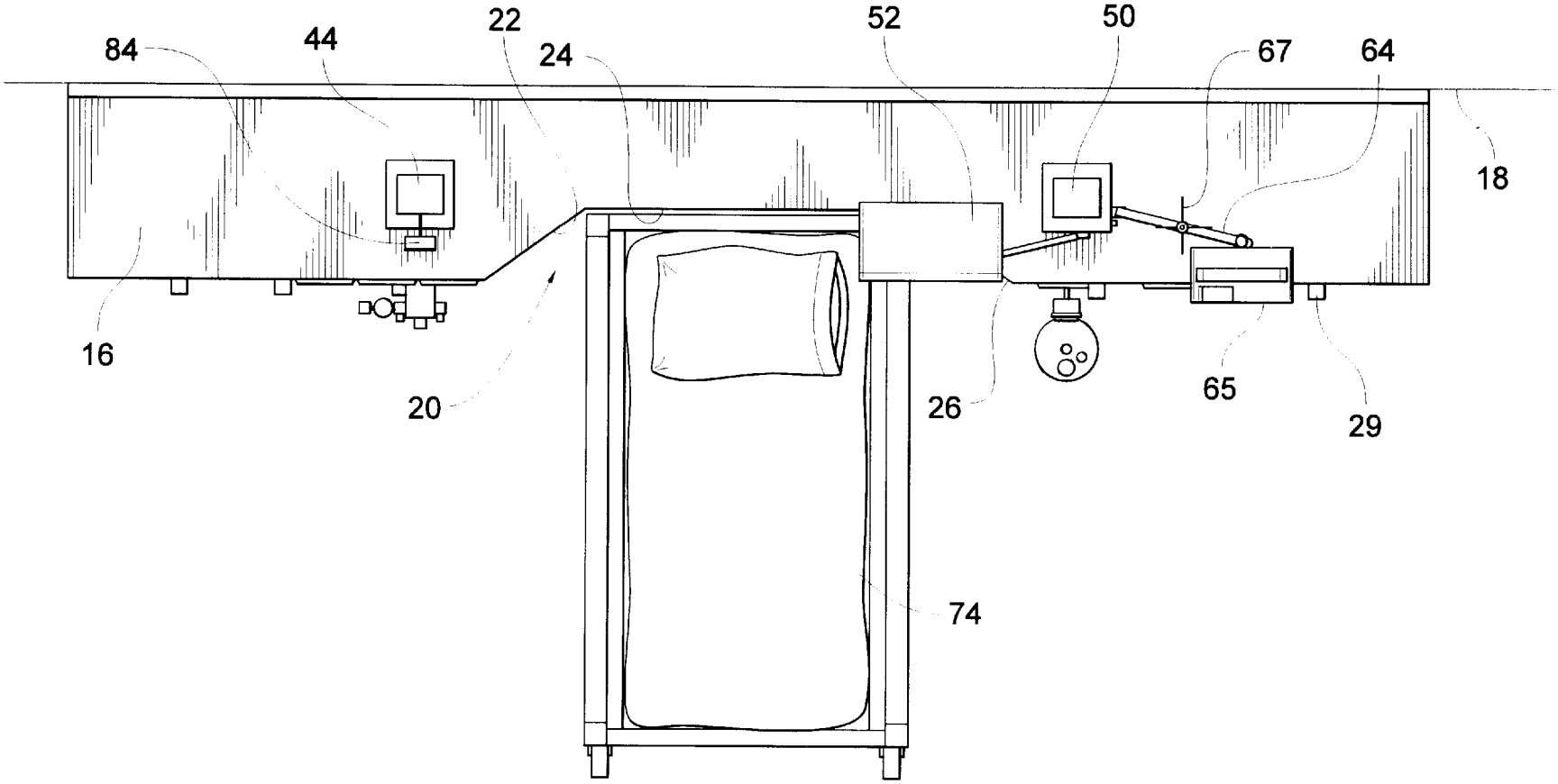
FIG. 3 is a top plan view of the neonatal infant care headwall fixture illustrated in FIG. 1 with an infant support structure located thereat.
Figure 4:
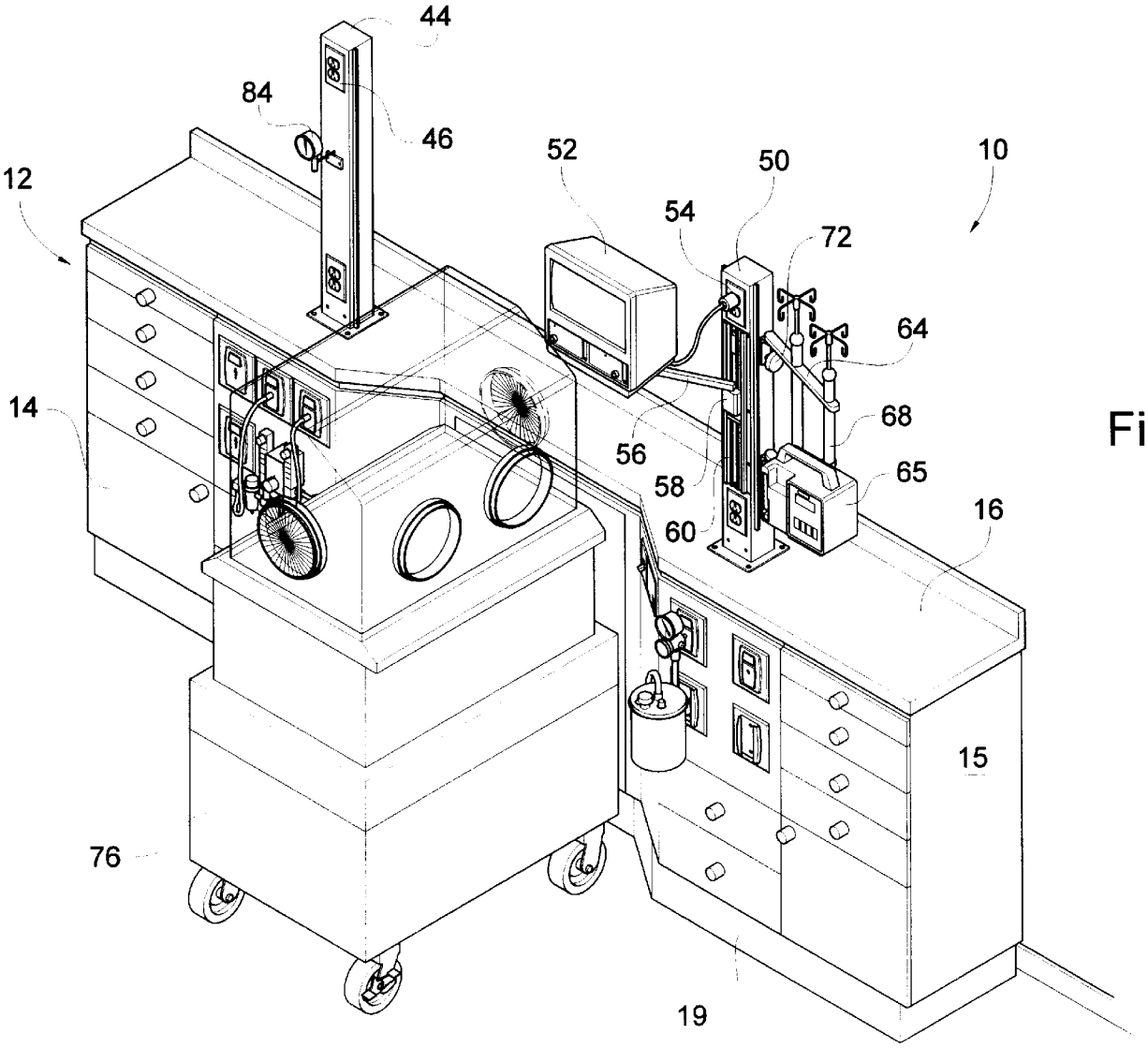
FIG. 4 is a perspective view of the neonatal infant care headwall fixture with another infant support structure located thereat.

In order to properly locate an infant care support structure such as a crib 74 as seen in FIG. 3 or an incubator 76 as seen in FIG. 4, a recess 20 is formed in the body to include the top surface 16 and the front surface 14. The recess 20 is centrally located between either end of the headwall fixture 10 and creates an indentation in the front surface 14 and the top surface 16 which extends almost halfway across the top surface 16 toward the hospital wall 18. The recess 20 is best seen in FIGS. 1 and 3. It is preferred that the recess be formed from three vertically oriented wall members 22,24, 26 which extend inwardly toward the hospital wall 18 from the outermost extent of the front surface 14. As best seen in FIG. 1, the recess 20 is also formed from three edge portions 22*a*, 24*a*, 26*a*, which are cut into the top surface 16 and which have an angular relationship and orientation that correspond generally to the angular relationship and orientation between wall members 22, 24, 26, as described hereafter. These vertically oriented wall members 22,24,26 are disposed at a predetermined angular relationship with one another with the center wall 24 of the three walls 22,24,26 being generally parallel with the outermost extent of the front surface 14. The width of the central wall 24 is slightly wider than the width of the infant support structure, such as the crib 74 and the incubator 76, seen in FIGS. 3 and 4, respectively. The recess 20 acts as the focal point for the entire headwall fixture 10 and allows the personnel associated with positioning the infant support structure to readily locate the infant support structure in its optimum position for neonatal infant care. As may be expected, the optimum position is associated with the optimum placement of equipment.

To enhance equipment placement, a pair of towers 44,50 are mounted to the top surface 16 and are formed as generally square rectangular members projecting vertically upwardly. They are mounted to the top surface 16 using a flange-like base 48,68 and conventional screws or bolts 49. Each tower 44,50 is placed on either side of the recess 20 for easy access by hospital personnel. It should be understood that the following descriptions of the towers offer specific structural features and these structural features, while illustrated on one tower or the other, are interchangeable and no one tower should be considered as the only configuration available.

A first tower 44 includes electrical sockets 46 for attachment of electrical power equipment. A pressure gauge 84 is mounted thereto in a cantilevered manner to illustrate the ability of the tower to accommodate various equipment.

Figure 2:
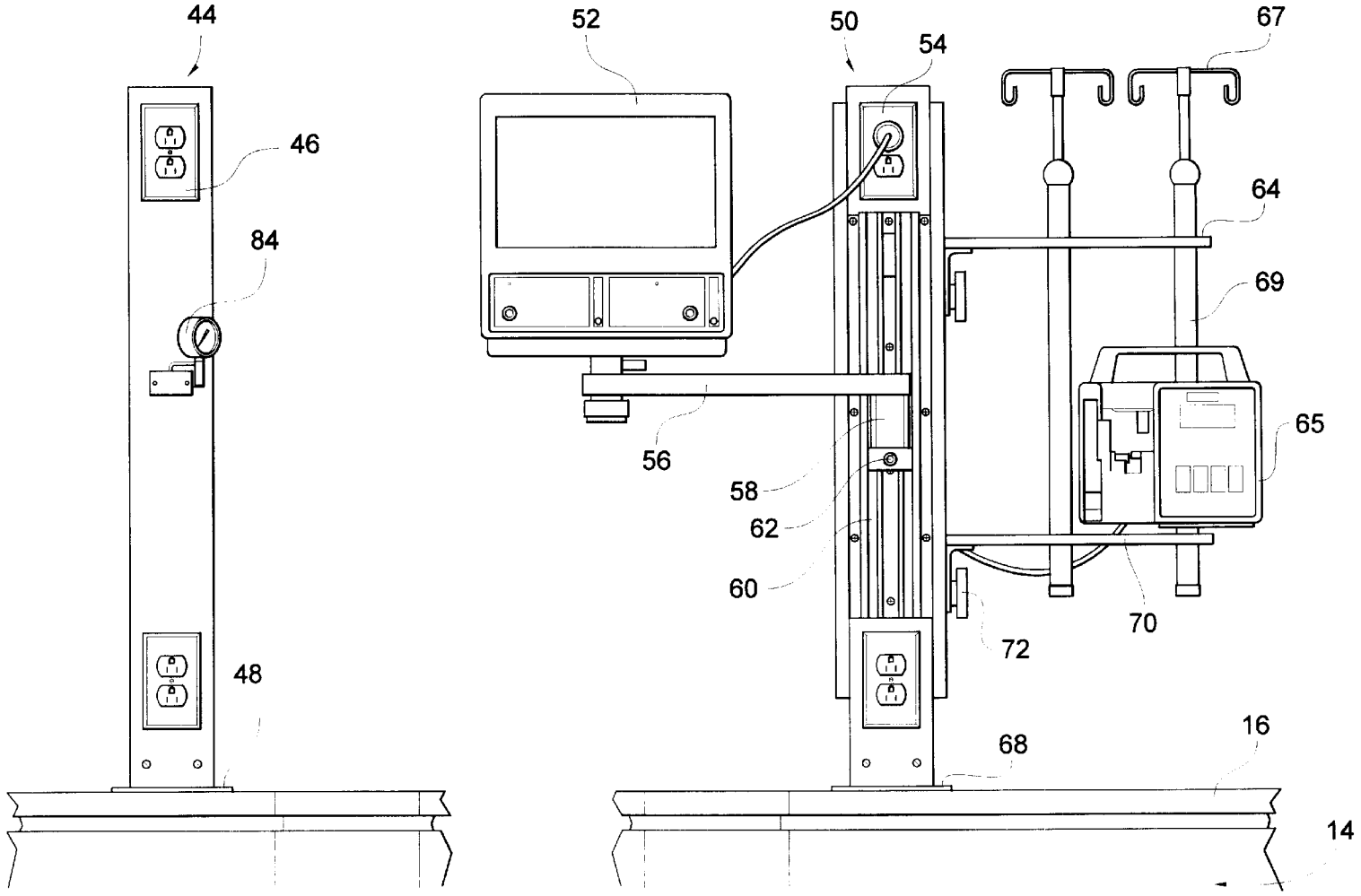
FIG. 2 is an elevational view of the tower structures associated with the neonatal infant care headwall fixture illustrated in FIG. 1.

A second tower 50 is somewhat more complex. As seen in FIG. 2, the second tower 50 is formed similarly to the first tower 44 and includes similar electrical outlets 54. A slider rack 60 is mounted to the side of the tower facing outwardly from the wall 18 and includes a slider 58 slidably mounted thereto. A locking nut 62 is provided to lock the slider in place. A pivotal arm 56 is mounted in a cantilevered manner to project outwardly from the slider 58 and supports some form of infant care equipment, shown as a monitor 52 connected to the electrical outlet 54 in FIG. 2. As may be expected, the lock nut 62 may be loosened and the slider 58 moved along the track 60 to position the monitor 52 at any predetermined vertical spacing from the top surface 16.

Optionally, two spaced parallelly oriented arms 64,70 are pivotally mounted to another side of the tower 50 and are tightened in place using hand wheel 72. Two downwardly projecting members 69 extend therebetween. These downwardly projecting members accommodate further equipment, such as the analyzer illustrated in FIG. 2. A plurality of hooks project upwardly from the downwardly projecting member 69 with the hooks 67 configured to hold scissors, hemostats, tape or other items off the top surface 16.

The lower portion, i.e., the portion of the body 12 disposed below the top surface 16, includes a variety of fittings and attachments. Initially, a plurality of drawers 28 are arrayed about the body in a conventional, cabinet-like manner and are accessible using drawer pulls 29. Additionally, fixtures to supply vacuum 82, as well as fixtures to supply air 78, are mounted to the front surface 14. As is typical, the air and oxygen are mixed in a mixer 36 which is likewise mounted to the front surface 14. Mounting members 32 are provided to mount such items on the front surface 14 in a slidable manner such that they may be interchanged with other necessary equipment. A vacuum service 82 is provided and is attached to an evacuator 34. As may be expected, these accessories and fixtures are interchangeable with other fixtures and accessories using the mounting members 32. A plurality of electrical outlets 30 are provided on one of the three vertical walls 22. The power service to the headwall fixture is electrically isolated and access to a power panel is provided through an opening 38 in the central vertical wall 24. An isolation monitor 42 is likewise provided adjacent the access panel 38. Control of power is provided through a central switch 40 mounted to a vertically oriented wall 26. Further, while not specifically illustrated, the lighting associated with the present invention is equally versatile and several different lighting combinations can be accessed by a plurality of switches to provide lighting of different intensities as is generally known.

Variable bedside lighting is essential for promoting developmental gains in critically ill infants. Offering a range of lighting from 20 through 60 footcandles allows for accurate clinical assessment while minimizing the effects of bright direct light exposure to the infant.

In operation, and as is best seen in FIGS. 3 and 4, the hospital personnel can easily locate an infant support structure 74,76 by aligning it with the central wall 24 associated with the recess 20. This places all the necessary life support and caregiving equipment in easy reach of the hospital personnel with the equipment being configured and disposed for easy application to the infant for which care is to be given.

By the above, the present invention provides a neonatal infant care headwall fixture which improves over the prior art by providing a positive location for the infant support structure which adds to its ease of use and locates necessary life giving equipment closely adjacent the infant under care to enhance the ability of the hospital personnel to provide the necessary care in a neonatal infant care facility.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A neonatal infant care headwall fixture defining an infant care station for concentrating infant care equipment in a neonatal infant care facility, said headwall comprising a body formed from a plurality of wall members including at least one vertically extending wall member defining a front surface and at least one horizontally extending wall member defining a top surface, said front surface and said top surface cooperating to define a recess for receiving therein at least a portion of an infant support structure to locate infant care equipment associated with said headwall fixture in juxtaposition with an infant support structure at least partially disposed within said recess, wherein said front surface defining said recess includes three vertically oriented wall members disposed in a predetermined angular relationship with one another to define said recess in said vertically extending wall member, and wherein said top surface includes three angularly oriented edge portions disposed in juxtaposition with said three vertically oriented wall members to define said recess in said horizontally extending wall member.

2. The neonatal infant care headwall fixture according to claim 1, wherein said headwall fixture includes at least one tower projecting upwardly from said horizontally oriented wall member for supporting infant care equipment associated with said headwall fixture.

3. The neonatal infant care headwall fixture according to claim 2, wherein said tower member includes an electrical power supply accessible from outside said tower.

4. The neonatal infant care headwall fixture according to claim 2, wherein said tower includes means for mounting infant care equipment thereto, said mounting means including means for releasably retaining said mounting means at a predetermined vertical spacing from said top surface.

5. The neonatal infant care headwall fixture according to claim 4, wherein said mounting means includes an equipment support arm extending from said tower in a cantilevered manner.

6. The neonatal infant care headwall fixture according to claim 5, wherein said means for releasably retaining said mounting means at a predetermined vertical spacing from said top surface includes a vertically oriented slider rack mounted to said tower, a slider movably disposed within said slider rack and having said support arm mounted thereto, and means for releasably locking said slider in a predetermined position along said slider rack for supported vertical positioning of infant care equipment along said tower.

7. The neonatal infant care headwall fixture according to claim 4, wherein said equipment support arm includes at least one downwardly projecting support member mounted thereto for supporting infant care equipment suspended therefrom.

8. The neonatal infant care headwall fixture according to claim 7 and further comprising a second cantilevered support arm mounted to said tower and said at least one downwardly projecting member to stabilize said at least one downwardly projecting member.

9. The neonatal infant care headwall fixture according to claim 1, wherein said body includes a plurality of selectively accessible storage compartments disposed therein, with access to said storage compartments being available from said front surface.

10. The neonatal infant care headwall fixture according to claim 1, wherein at least one of said three vertically oriented wall members includes means for accessing electrical power formed therein.

11. The neonatal infant care headwall fixture according to claim 10, wherein said means for accessing electrical power includes at least one electrical socket mounted to one of said vertically oriented wall members.

12. A neonatal infant care headwall fixture defining an infant care station for concentrating infant care equipment in a neonatal infant care facility, said headwall comprising:

a body formed from a plurality of wall members including at least one vertically extending wall member defining a front surface and at least one horizontally extending wall member defining a top surface, said front surface and said top surface cooperating to define a recess for receiving therein at least a portion of an infant support structure to locate infant care equipment associated with said headwall fixture in juxtaposition with an infant support structure at least partially disposed within said recess, said front surface defining said recess including three vertically oriented wall members disposed in a predetermined angular relationship with one another to define said recess in said vertically extending wall member, said top surface including three angularly oriented edge portions disposed in juxtaposition with said three vertically oriented wall members to define said recess in said horizontally extending wall member; and at least one tower projecting upwardly from said horizontally oriented wall member for supporting infant care equipment associated with said headway fixture, said tower including means for mounting infant care equipment thereto, said mounting means including means for releasably retaining said mounting means at a predetermined vertical spacing from said top surface.

13. The neonatal infant care headwall fixture according to claim 12, wherein said tower member includes an electrical power supply accessible from outside said tower.

14. The neonatal infant care headwall fixture according to claim 12, wherein said mounting means includes an equipment support arm extending from said tower in a cantilevered manner.

15. The neonatal infant care headwall fixture according to claim 14, wherein said means for releasably retaining said mounting means at a predetermined vertical spacing from said top surface includes a vertically oriented slider rack mounted to said tower, a slider movably disposed within said slider rack and having said support arm mounted thereto, and means for releasably locking said slider in a predetermined position along said slider rack for supported vertical positioning of infant care equipment along said tower.

16. The neonatal infant care headwall fixture according to claim 12, wherein said equipment support arm includes at least one downwardly projecting support member mounted to said support arm for selective vertical positioning of infant care equipment suspended therefrom.

17. The neonatal infant care headwall fixture according to claim 12, wherein said body includes a plurality of selectively accessible storage compartments disposed therein, with access to said storage compartments being available from said front surface.

18. The neonatal infant care headwall fixture according to claim 12, wherein at least one of said three vertically oriented wall members includes means for accessing electrical power formed therein, said means for accessing electrical power including at least one electrical socket mounted to one of said vertically oriented wall members.

* * * * *